US005503328A

United States Patent [19]

Roccaforte et al.

[11] Patent Number: 5,503,328

[45] Date of Patent: Apr. 2, 1996

[54] MULTI-USE ENVELOPE

[75] Inventors: Harry I. Roccaforte, Chicago, Ill.; Mark E. Philion, Eagan, Minn.; Charles T. Keshner, Oak Park, Ill.

[73] Assignee: Waldorf Corporation, St. Paul, Minn.

[21] Appl. No.: 394,065

[22] Filed: Feb. 24, 1995

Related U.S. Application Data

[63] Continuation of Ser. No. 61,119, May 13, 1993, abandoned.

[51] Int. Cl.[6] ..... B65D 27/30

[52] U.S. Cl. ..... 229/301; 229/80; 229/313; 229/316; 383/5

[58] Field of Search ..... 229/1.5 R, 302, 229/309, 311, 313, 316, 314, 301, 925, 80, 300; 383/5

[56] References Cited

U.S. PATENT DOCUMENTS

| | | | |
|---|---|---|---|
| 211,725 | 1/1979 | Foster . | |
| 754,201 | 3/1904 | Davalos . | |
| 841,699 | 1/1907 | Lawson | 229/80 |
| 1,091,172 | 3/1914 | Thayer | 229/302 |
| 1,568,880 | 1/1926 | Conklin | 229/300 X |
| 1,896,425 | 2/1933 | Scarfi . | |
| 2,345,793 | 4/1944 | Chapel | 292/314 X |
| 2,859,907 | 11/1958 | McFarland . | |
| 3,520,472 | 7/1970 | Kukulski | 229/80 |
| 4,483,018 | 11/1984 | Whelan | 383/5 |
| 4,765,485 | 8/1988 | Perkins | 229/316 X |
| 4,923,111 | 5/1990 | Down | 229/1.5 R X |
| 5,213,258 | 5/1993 | Kim . | |

FOREIGN PATENT DOCUMENTS

| | | | |
|---|---|---|---|
| 52946 | 4/1991 | Australia | 383/5 |
| 0341941 | 1/1937 | Italy | 229/311 |
| 0680124 | 6/1992 | Switzerland | 229/301 |
| 2167381 | 5/1986 | United Kingdom | 383/5 |
| 16784 | 10/1993 | United Kingdom . | |
| 9212064 | 7/1992 | WIPO | 229/311 |

OTHER PUBLICATIONS

Commercially available "FEDEX LETTER" package, copyright 1993 Federal Express Corporation.

Commercially available "EXPRESS MAIL" package, copyright USPS 1990.

*Primary Examiner*—Jes F. Pascua

*Attorney, Agent, or Firm*—Schwegman, Lundberg & Woessner

[57] ABSTRACT

In accordance with the present invention a multiple use envelope for safely sending material to successive recipients is provided. The envelope broadly is a paperboard container having a generally rectangular, substantially closed body with one open edge opening into an interior cavity for receiving material. A closure flap is connected to the body adjacent the open edge and can be manipulated to close the opening. On its interior surface, the closure flap carries two parallel sealing strips and two parallel opening strips for use by first and second senders and recipients. On its exterior surface, the closure flap carries an indicia receiving security block overlying at least a portion of at least one of the two opening strips. The invention also encompasses a flat paperboard blank for forming into the envelope.

7 Claims, 13 Drawing Sheets

MULTI-USE ENVELOPE

This is a continuation of application Ser. No. 08/061,119 filed May 13, 1993, now abandoned.

TECHNICAL FIELD

The present invention relates to envelopes and, more particularly, to a multiple use mailing or courier envelope wherein the envelope may be used to send items to more than one recipient successively, and wherein the envelope includes a security feature for providing that only intended recipients open the envelope.

BACKGROUND OF THE INVENTION

U.S. Pat. No. 1,896,425 (to Scarfi) discloses an envelope which may be sealed several times in a successive manner so that the envelope may be used several times for mailing purposes, and is provided with means for separating the closure flap from the body of the envelope so that no tools or letter-openers are required in the opening operation. The envelope includes a closure flap comprising two strips, a main closure strip, which has its obverse surface treated with glue, and an auxiliary closure flap continuing therefrom. The auxiliary flap is folded over to lie flat upon the main flap but does not adhere to the glued surface of the latter. Basically, the Scarfi envelope provides a plurality of closure flaps wherein a top closure flap has an upper gummed surface which is the first flap used to originally seal the envelope. A string is used to separate the auxiliary flap from the main closure flap, thereby opening the envelope. For a second or successive use of the envelope, the gummed surface of the main flap is caused to adhere to the body of the envelope, and the envelope is opened a second time by pulling the second string.

While the envelope disclosed by Scarfi provides for successive or multiple uses, there are some unaddressed problems. There is no disclosure of a security mechanism or tamper-evidencing feature for ensuring that contents are received by the intended recipient. The gummed or glue-treated surfaces of the envelope are unprotected prior to activation or use. This can lead to unwanted activation, deterioration or contamination of the glue-treated or gummed surface. A related problem is that because the gummed surfaces are unprotected, the overlaid auxiliary and main flaps may become stuck together rendering the envelope inoperative for its intended purpose. The ends of the opening strings of the Scarfi envelope project from the edges of the envelope and this can damage automatic handling equipment or cause premature tearing of the envelope itself.

U.S. Pat. No. 2,859,907 (to McFarland), particularly FIGS. 10–13 thereof, discloses an envelope including a sealing and opening tape with a protective layer or release coating on at least one side. U.S. Pat. Nos. 211,725 (to Foster), 754,201 (to Davalos) and British Patent 16,784 (to Cooper) disclose envelopes with tearing strips formed by one or more lines of weakness. However, there is no disclosure or suggestion in these patents about how to achieve an envelope for more than one successive use, nor is there any suggestion about providing a dedicated, tamper-evidencing security feature for a multiple use envelope.

Although the envelopes disclosed in the above-noted patents and commercially available envelopes, particularly air express envelopes such as those used by "Federal Express"®, represent improvements in the art, if such envelopes could be used securely more than once, i.e., by successive senders and recipients, expensive natural resources could be saved. Additionally, it would be advantageous if such multi-use envelopes could be converted practically and easily to another use after being used by more than one sender and recipient, saving additional money and resources.

Clearly with current envelope technology, efficiency, security and conservation are not optimized. Accordingly, there is a need for a durable, cost efficient, secure multiple-use envelope.

SUMMARY OF THE INVENTION

In accordance with the present invention, an envelope-type container for sending material to a recipient is provided. The envelope broadly comprises a paperboard container having a generally rectangular, thin, substantially closed body with one open edge opening into an interior cavity for receiving contents. A closure flap is connected to the body adjacent the open edge and can be manipulated to close the opening. The envelope includes a security means for providing for the secure transmittal of contents comprising at least one signature block or indicia receiving location on the closure flap. At least one removable portion of the body adjacent to the closure flap enables the envelope to be converted to a filing folder for long term use. The invention encompasses a flat paperboard blank for forming into the envelope of the present invention.

In its preferred embodiment, the present invention includes a closure flap carrying at least two parallel adhesive seal strips, each being covered by a removable release layer. At least two tear opening strips are carried by the closure flap. The seal and tear strips alternate, a first tear strip being between the seal strips, and a second tear strip being between the connection between the closure flap and the body and the seal strip most closely adjacent to the body when the closure flap is coplanar with the body, i.e., not closed. The connection between the closure flap and the envelope body, the seal strips and the tear strips are generally parallel and the seal and tear strips extend substantially for the length of the closure flap. The security signature blocks are immediately adjacent at least one of the tear strips, on the side of the closure flap exposed when the envelope is sealed, and at least partially overlie one of the tear strips.

A first alternative embodiment of the multiple use envelope of the present invention comprises an envelope initially having two open edges and a multiple sealing and opening arrangement wherein a first sealing and opening flap, carrying two sealing adhesive strips and a parallel opening tear strip therebetween, is foldably connected to the envelope body along one edge and a second opening flap carrying at least one adhesive strip and one parallel tear opening strip is foldably connected to the envelope body along a second edge, either an edge perpendicular or an edge parallel to the foldable connection between the body and the first sealing and opening flap. Similarly, in other embodiments, two or more sealing and opening flaps may be provided, one at each edge of the envelope body.

An object of the present invention is to provide a multi-trip courier mailing envelope having a material receiving cavity defined by two major, generally parallel rectangular side wall panels. The envelope initially has at least one open edge and one or both of the side wall panels carry closure flaps including a main openable closure flap for closing the at least one open edge. The closure flap for closing the open edge carries at least two parallel self-adhesive tape closing strips for securing the flap to one of the side wall panels and at least two parallel tear strips for opening the envelope. The closure flap carrying the tape and tear strips may be either a long end closure flap or a short end closure flap, or both. Alternatively, two adhesive tape strips with a single tear tape therebetween may be carried on one closure flap and a single adhesive strip and single tear strip may be carried on a selected another of the four closure flaps. Another closing tape strip may be added to the latter selected another closure flap as a fail-safe device, i.e., even if the first receiver or addressee opens the tear strip intended for use by a subsequent addressee, the envelope can be resealed and used again.

Another object of the present invention is to provide an envelope including a security means for protecting valuable or sensitive items contained therein, wherein the security means comprises at least one signature, seal or code security block or box overlying at least one opening tear strip on the exterior of the envelope. Similarly, more than one security block may be provided for a single tear strip, each tear strip may have associated security signature blocks, and the security means may include a "travelers-check" arrangement, wherein security blocks are provided in one or more locations on the envelope, including one or more locations on one or more closure flaps, for receiving matching signatures or security codes.

Yet another object of the present invention is to provide a mailing container for securely sending material from multiple successive senders to multiple successive recipients.

Still another object of the present invention is to provide a mailing envelope for shipping material from a first sender to a first recipient, whereby the first recipient may reuse the envelope to send material to a second recipient, and wherein each recipient is provided with means, a tear strip or filament, for facilitating the opening of the envelope and each sender is provided with means, a security signature block, for ensuring that the envelope is opened only by the intended recipient.

An advantage of the present invention is that it combines easy opening and durability in a multi-use mailing envelope having a tear resistant body and at least one closure flap with elongated tear strips or filaments which make it easy for a recipient to open the envelope.

Another advantage of the envelope of the present invention is that it combines multiple use mailing, i.e., it may be sent and received by more than one sender and recipient, with a useful end use as a durable file folder providing easy access to stored documents, secure storage thereof, and means for identifying the stored contents.

Other advantages of the present invention are: it can be used with suitable supplemental packaging and mailing materials, such as overwraps and labels, and it may be provided in various sizes to contain many different materials without substantial redesign or reconfiguration of the basic design.

Other objects and advantages of the present invention will become more fully apparent and understood with reference to the following specification and to the appended drawings and claims.

DETAILED DESCRIPTION OF THE PREFERRED EMBODIMENT

Figure 1:
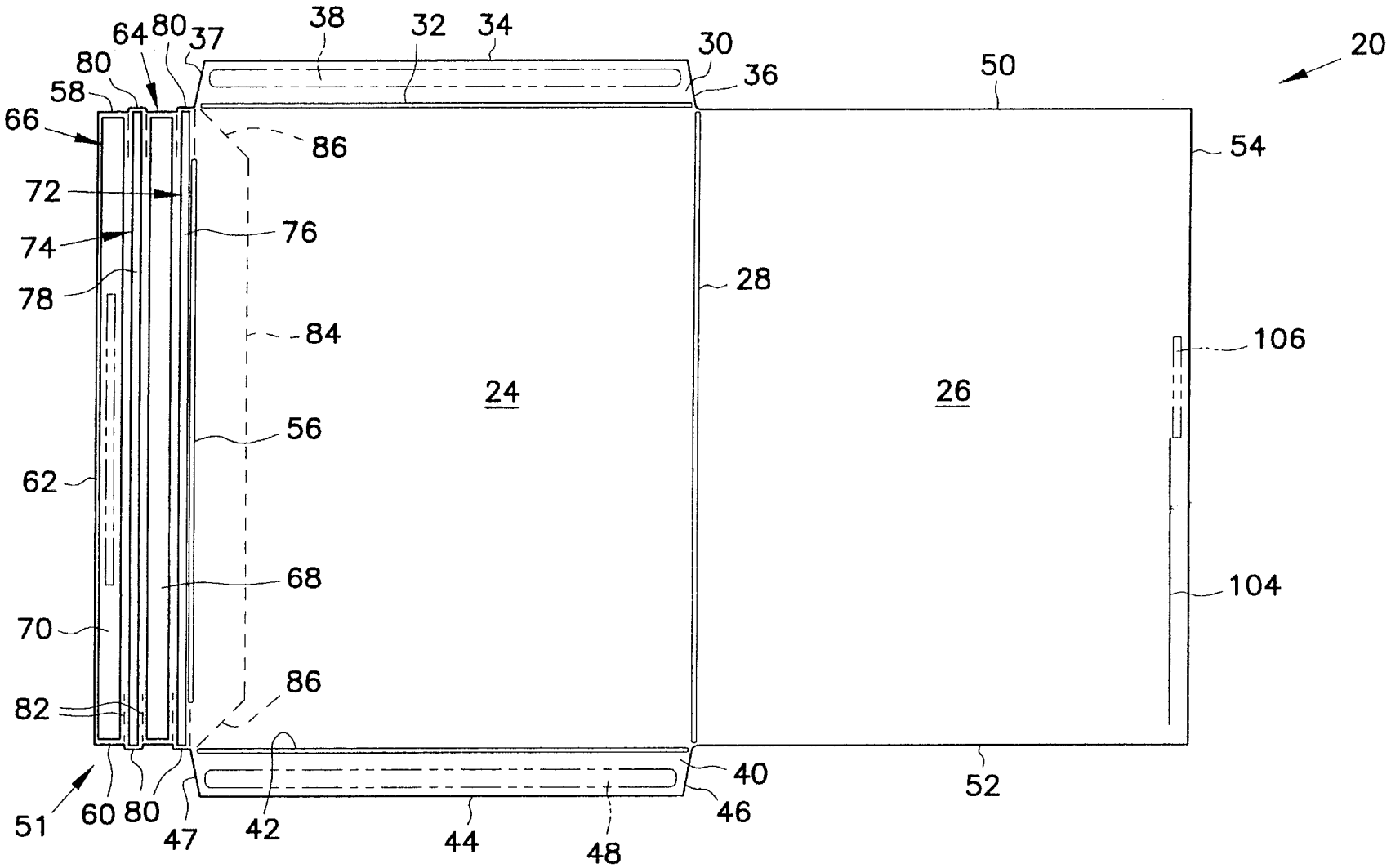
FIG. 1 is a plan view of a die-cut and scored blank for forming the envelope of the present invention, the inside side of the blank being shown.
Figure 2:
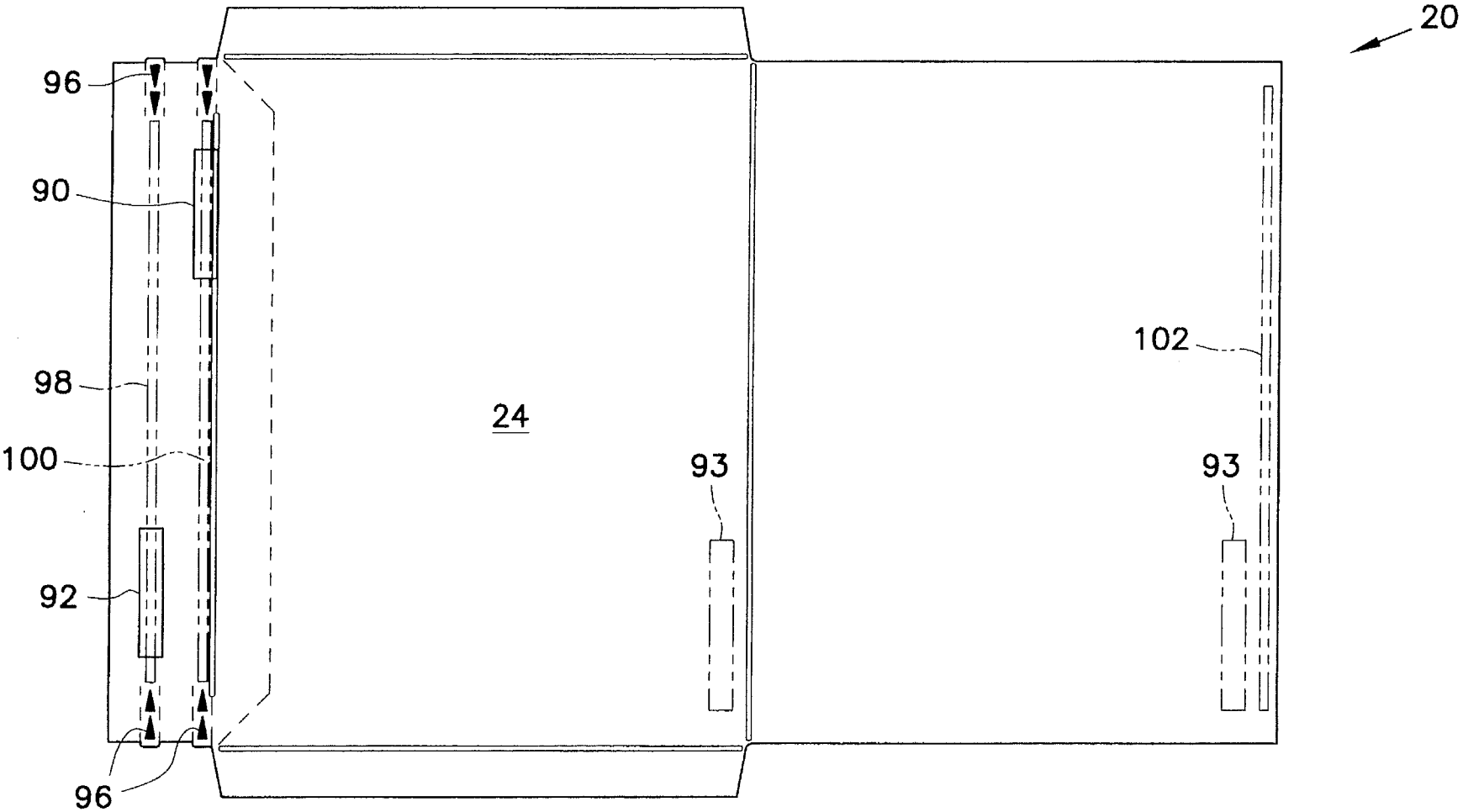
FIG. 2 is a plan view of the blank shown in FIG. 1, showing the opposite side of the blank, the side which is the exterior of the envelope erected therefrom.
Figure 4:
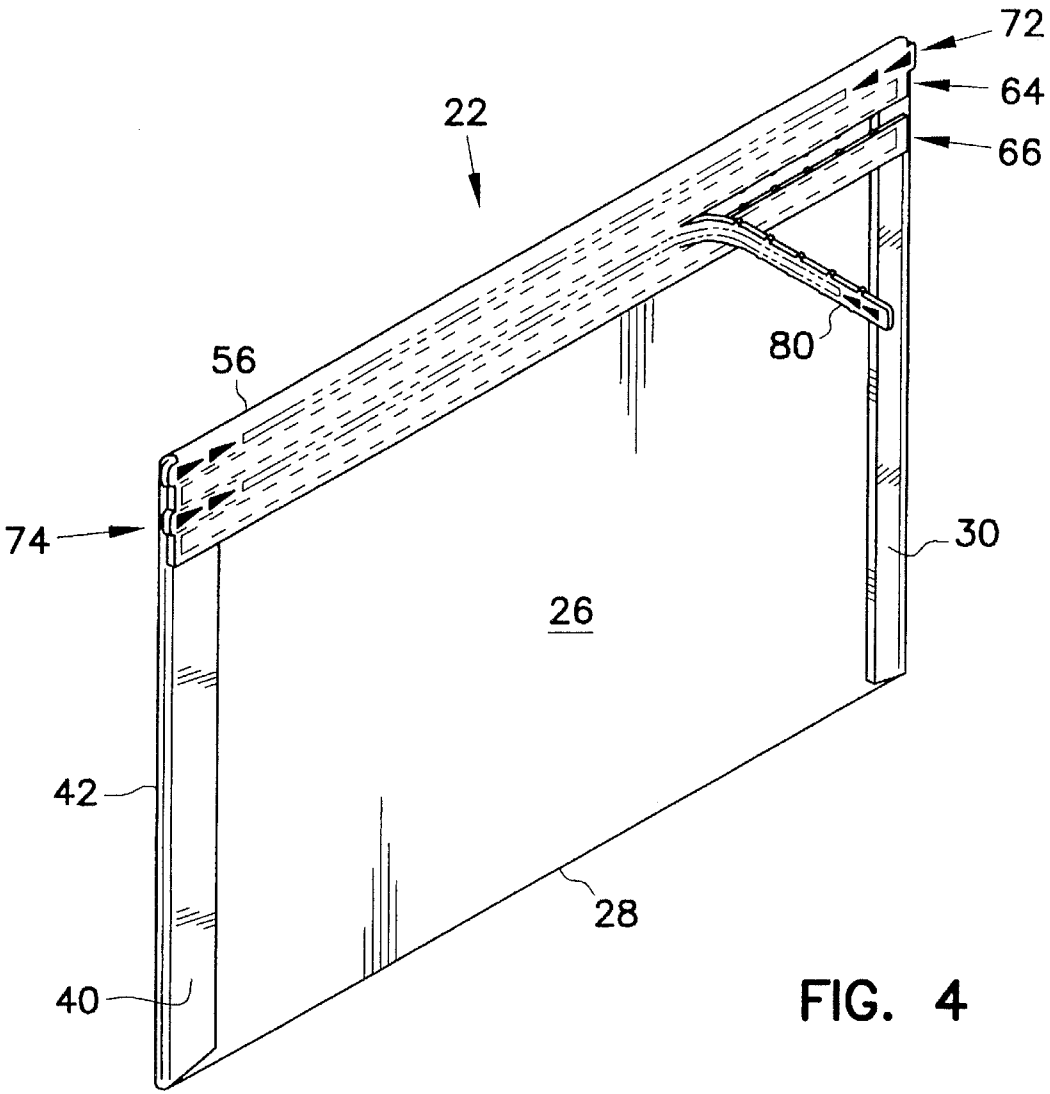
FIG. 4 is a perspective view depicting the envelope of the present invention sealed and ready for sending, also depicting the beginning of opening the envelope by the first recipient.

FIGS. 1 and 2 depict a die-cut blank 20 for forming, in accordance with the present invention, the courier type mailing envelope 22 depicted, substantially sealed and ready for use, in FIG. 4. In the drawings, double lines indicate scores used to form fold lines and single solid or single dashed lines indicate cuts, edges or free edges, except where otherwise indicated.

The blank 20 is made from paperboard and includes a front wall panel 24 foldably connected or articulated to a rear wall panel 26 at a fold line 28. A first closure flap 30 is foldably connected to the front panel 24 at a fold line 32 generally perpendicular to the fold line 28. The first closure flap has a free long edge 34, two tapered end edges 36, 37 and carries a generally central permanent adhesive region 38. A second end closure flap 40 is foldably connected to the front panel 24 along a fold line 42 which is generally parallel to the fold line 32. The second closure flap 40 is substantially similar to the first closure flap 30, having a long free edge 44, short tapered free edges 46, 47 and an adhesive region 48.

The rear panel 26 is substantially similar to the front panel 24 and is defined by the fold line 28, a first free edge 50 collinear with the fold line 32, a second free edge 52 collinear with the fold line 42, and a third long free edge 54, generally parallel to the fold line 28.

With continued reference to FIGS. 1 and 2, the blank 20 includes a main openable closure flap 51. The main closure flap 51 is foldably connected to the front panel 24 along a fold line 56 which is generally parallel to the fold line 28. The main closure panel 51 is further defined by free end edges 58, 60, the end edge 58 being collinear with fold line 32 and the end edge 60 being collinear with the fold line 42. The main closure panel 51 has a long free edge 62 generally perpendicular to the end edges 58, 60, and parallel to the fold lines 56, 28 and free edge 54 of the rear panel 26.

The main openable closure flap 51 includes two parallel adhesive seal strips or regions 64, 66. The adhesive sealing regions or strips 64, 66 are between the fold line 56 and the free edge 62 and may be formed by affixing the well-known two-sided adhesive tape to the interior or inside of the main closure flap 51. Such tape is well-known, having two adhesive surfaces each protected by release layer. One of the sides connects the tape to the closure flap 51, the other remains covered by the peel-off release or protective layer 68, 70, respectively.

The openable closure flap 51 includes two tear strips 72, 74. Referring specifically to FIG. 1, the tear strips 72, 74 include a plastic reinforcing tear filament 76, 78, respectively. The filaments 76, 78 comprise strong tensile tape which may carry pre-applied adhesive to adhere it to the interior surface of the closure flap 51 or the filaments 76, 78 may be glued in place by suitable adhesives applied to the closure flap 51. The tear filaments 76, 78 are parallel, with respect to each other, with respect to the sealing region 64, 66, and with respect to the fold line 56 joining the main closure panel 51 to the front panel 24. The tear strips extend linearly across the main closure flap 50 from one edge to the other (free edges 58, 60). Adjacent each end, an associated tear tab 80 is formed in the main closure panel 51. The tabs 80 are all substantially similar and are formed by weakening cut lines 82 on either side of the tear filaments 76, 78. Although the tab ends are substantially collinear with the free edges 58, 60, they may extend slightly therefrom to facilitate grasping the tabs 80.

The front panel 24 includes a line of weakness 84 formed by a plurality of linear perforations or cuts separated by nicks. The line of weakness 84 is generally parallel to fold lines 28, 56 and extends substantially across the front panel 24 adjacent to the main closure flap 51. At each end of the line of weakness 84 a plurality of parallel cuts 86 angle toward the corners of the front panel 24 formed by the intersection of the fold line 56 and the fold lines 32, 42, connecting the ends of the line of weakness 84 to the corners.

Referring specifically to FIG. 2, the exterior side of the blank 20 carries security signature blocks 90, 92. Additional security signature blocks may be provided as indicated by the blocks 93, depicted in phantom. Security blocks 90, 92 overly the tear strips 72, 74 on the opposite side of the closure flap 51 and may be formed by printed lines, by providing a debossed or depressed area on the exterior surface of the blank 20, or by providing embossed or raised lines defining the blocks 90, 92. With continued reference to FIG. 2, the exterior surface of the blank 20 may be printed with suitable text or instructions including starter arrows 96, first receiver instructions 98, second receiver instructions 100 and folder conversion instructions 102. The inside surface of the rear panel 26 (refer to FIG. 1) may be provided with a single printed line 104 along the free edge 54, as well as instructions indicia as represented at block 106.

Figure 3:
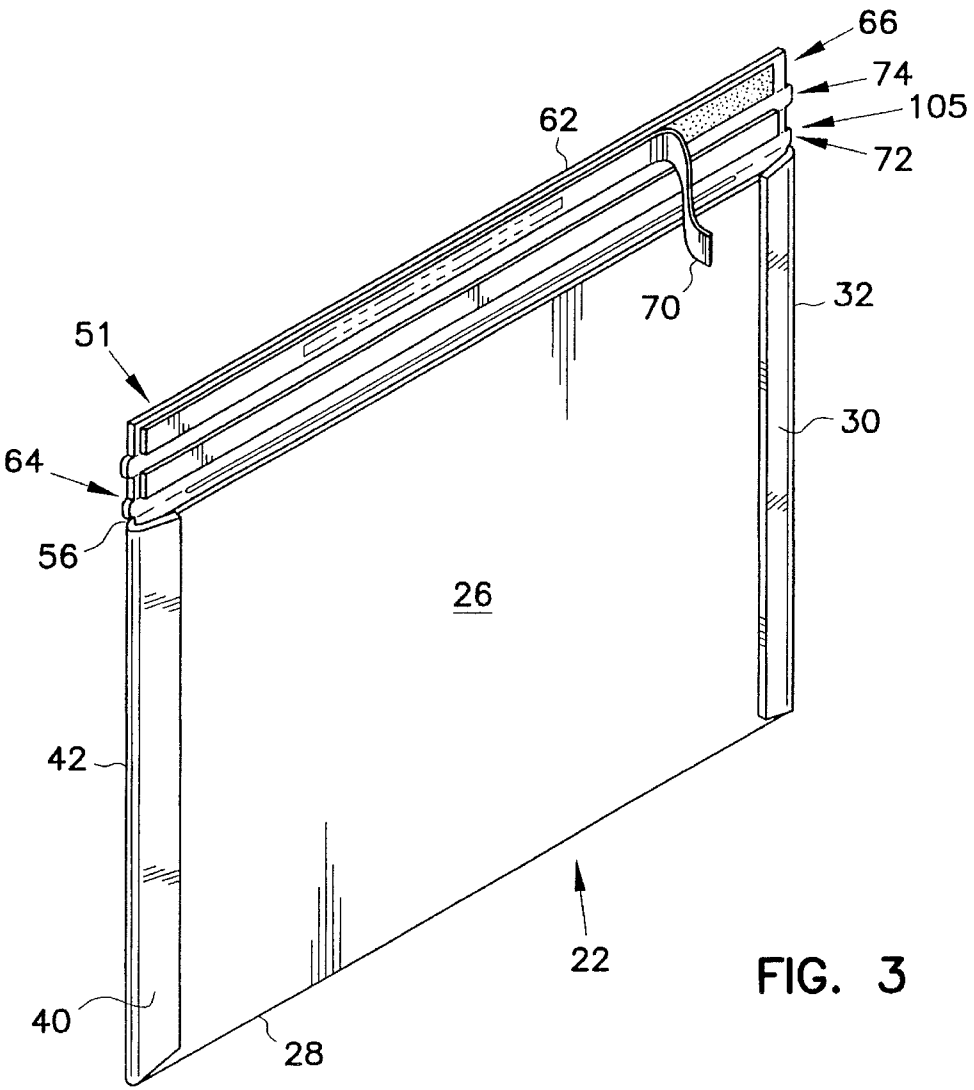
FIG. 3 is a perspective view of the envelope of the present invention folded up and ready to receive contents, and further depicting a first adhesive seal protecting element partially removed by the first sender.
Figure 5:
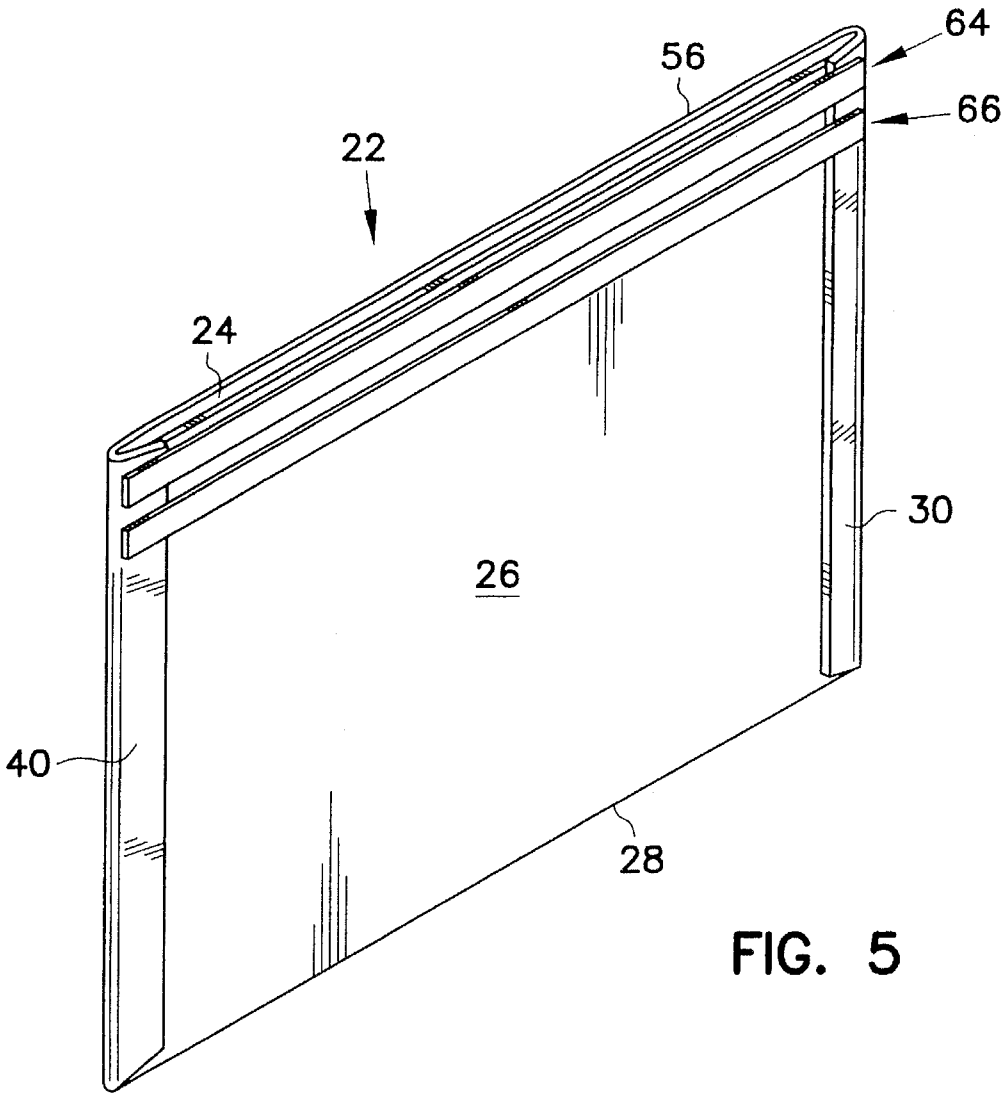
FIG. 5 is a perspective view of the envelope of the present invention depicting it fully opened by a second receiver.

Referring to FIGS. 3–5, particularly FIG. 4, the blank 20 is shown assembled into the envelope 22 of the present invention. To foldably erect the blank 20, the rear wall panel 26 is folded along the fold line 28 until it is generally parallel and closely adjacent to the front wall panel 24. The closure flaps 30, 40 are folded along the fold lines 32, 42, respectively, until they overly the rear wall panel 26. The adhesive regions 38, 48 carried by the closure flaps affix the flaps 30, 40 permanently in place. The closure flaps 40, 30 are affixed to the exterior surface of the rear panel 26 to create an interference free envelope cavity. Folding the blank 20 as just outlined produces an envelope 22 having the configuration depicted in FIG. 3; the folding and gluing may be done at the time of manufacture, leaving an open edge or segment 105 along the fold line 56 adjacent to the main closure flap 51. A first sender may insert contents into the envelope 22 while it is in the configuration depicted in FIG. 3. As is also depicted in FIG. 3, after contents are inserted, the peel-off release layer 70 covering the adhesive strip 66 closest to the free edge 62 of the main closure flap 50 may be removed and the closure flap 51 as a whole is folded downwardly about the fold line 56 until it contacts and is generally parallel to the rear wall panel 26. Thus, the envelope 22 is sealed by the first sender.

FIG. 4 depicts the opening of the envelope 22 when it arrives at the first addressee or recipient. Specifically, the first recipient grasps the tear tab 80 associated with the tear strip 74 to remove it completely as shown in FIG. 5. The tear filament 78 underlying the strip 74 cuts the flap 51 in a line across the extent of the flap 51. Either tab 80 at the ends of the tear strip 74 can be used to start tearing. After the strip 74 is removed, the closure flap 51 may be unfolded about line 56 until it is again coplanar with the front panel 24 (as shown in FIG. 3) and the contents of the envelope 22 may be extracted.

The first recipient may then become the second sender by refilling the envelope 22, removing the peel-off tape 68 in the second adhesive strip region 64, and refolding the closure flap 51 about the fold line 56 until it again overlies the rear panel 26. The envelope 22 will then substantially be in the condition depicted in FIG. 4; however, the first tear strip 74 will be missing as shown in FIG. 5. In this condition, the envelope 22 may be mailed to another, second recipient who, upon receipt, grasps a tab 80 at either end of the second receiver's tear strip 72 and removes the tear strip 72 from the envelope 22. The contents of the envelope 22 can be extracted, and the envelope 22 will have the configuration depicted in FIG. 5.

Figure 6:
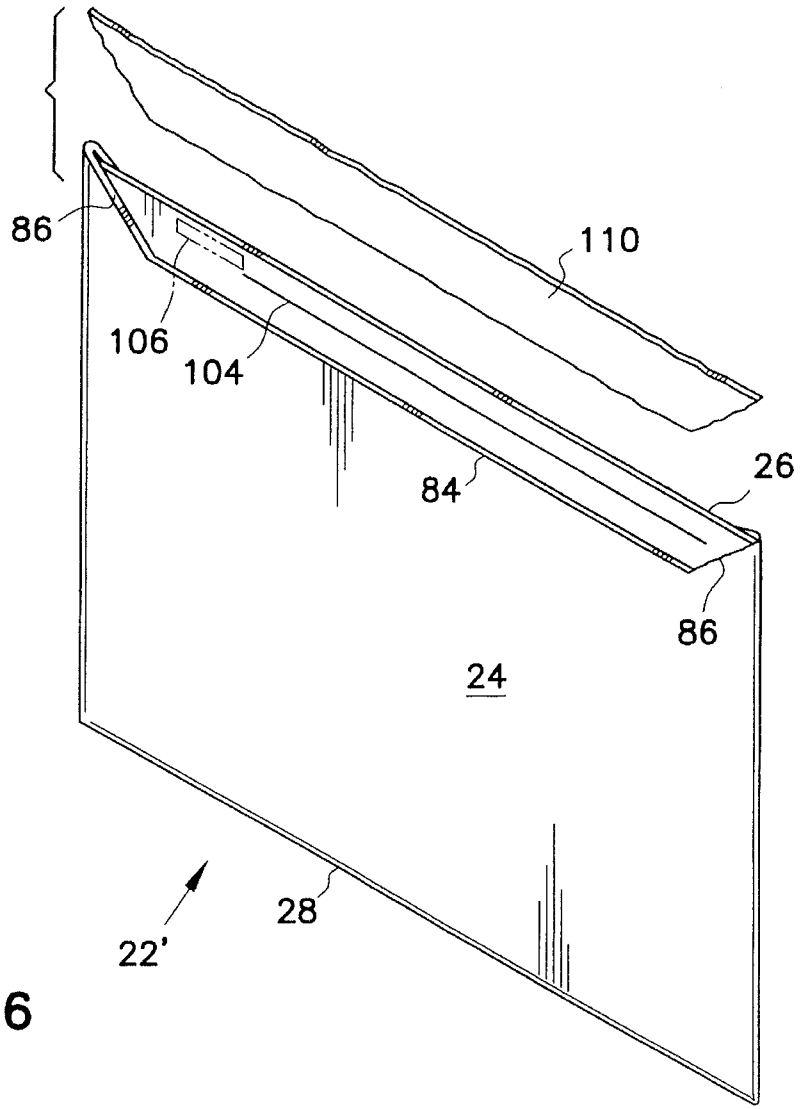
FIG. 6 is a perspective view depicting the reverse side of the envelope depicted in FIG. 5 with the filing folder enabling removable segment depicted removed therefrom in an exploded view.

FIG. 6 depicts a filing folder 22' created or adapted from the envelope 22. Specifically, the front panel 24 includes a removable segment or portion 110 defined by the line of weakness 84 and the end lines of weakness 86. The file folder configuration 22' is obtained by separating the segment 110 from the body of the envelope. This reveals the labeling line 104 as well as the text portion 106.

Figure 7:
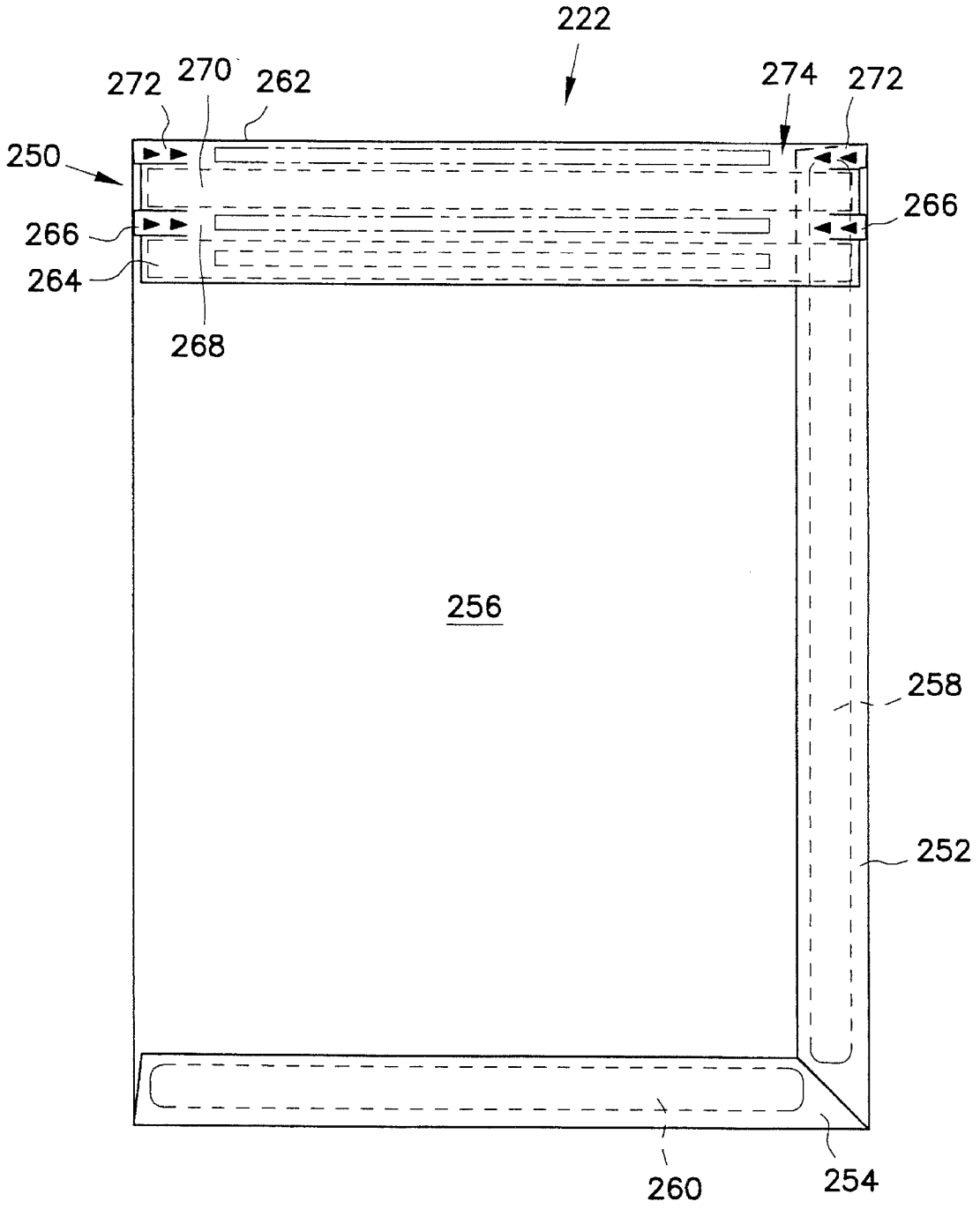
FIG. 7 is a plan view of a first alternative embodiment of the envelope of the present invention sealed and ready for sending.

FIG. 7 depicts a second preferred embodiment of the invention. This second embodiment, similar in many respects to the embodiment depicted in FIGS. 1–6, comprises a multiple-use mailing envelope 222. The blank for forming the second embodiment envelope 222 is not depicted but is substantially similar to the blank 20 (depicted in FIGS. 1–6) except that the second embodiment 222 includes a main closure flap 250 at one of the short ends of the envelope 222 rather than the long end of the envelope as depicted in FIGS. 1–6. In folding the blank to create the second embodiment of the envelope 222, the first closure flap 252 and second end closure flap 254 are folded in to overlie the rear wall panel 256 and permanently glued in place at adhesive regions depicted at 258, 260. The main closure panel 250 will be adjacent the remaining open edge of the envelope. The envelope 222 can be filled through the open edge and the main closure flap 250 folded about the fold line 262 until it overlies the rear panel 256.

Before folding the flap 250 about line 262, the first sender removes the release layer covering the adhesive strip 264 whereby the flap 250 will be adhered to the body of the envelope 222. The first recipient may grasp either of tabs 266 to remove the first tear strip 268 to open the envelope. After removing the contents, the envelope 222 can be refilled and resent by removing the release layer of the second adhesive 270, whereby the main closure flap 250 can be reconnected to the rear wall 256 of the envelope 222. Upon receipt, the second recipient grasps either of the tabs 272 to remove the second tear strip 274 to gain access to the contents.

Figure 8:
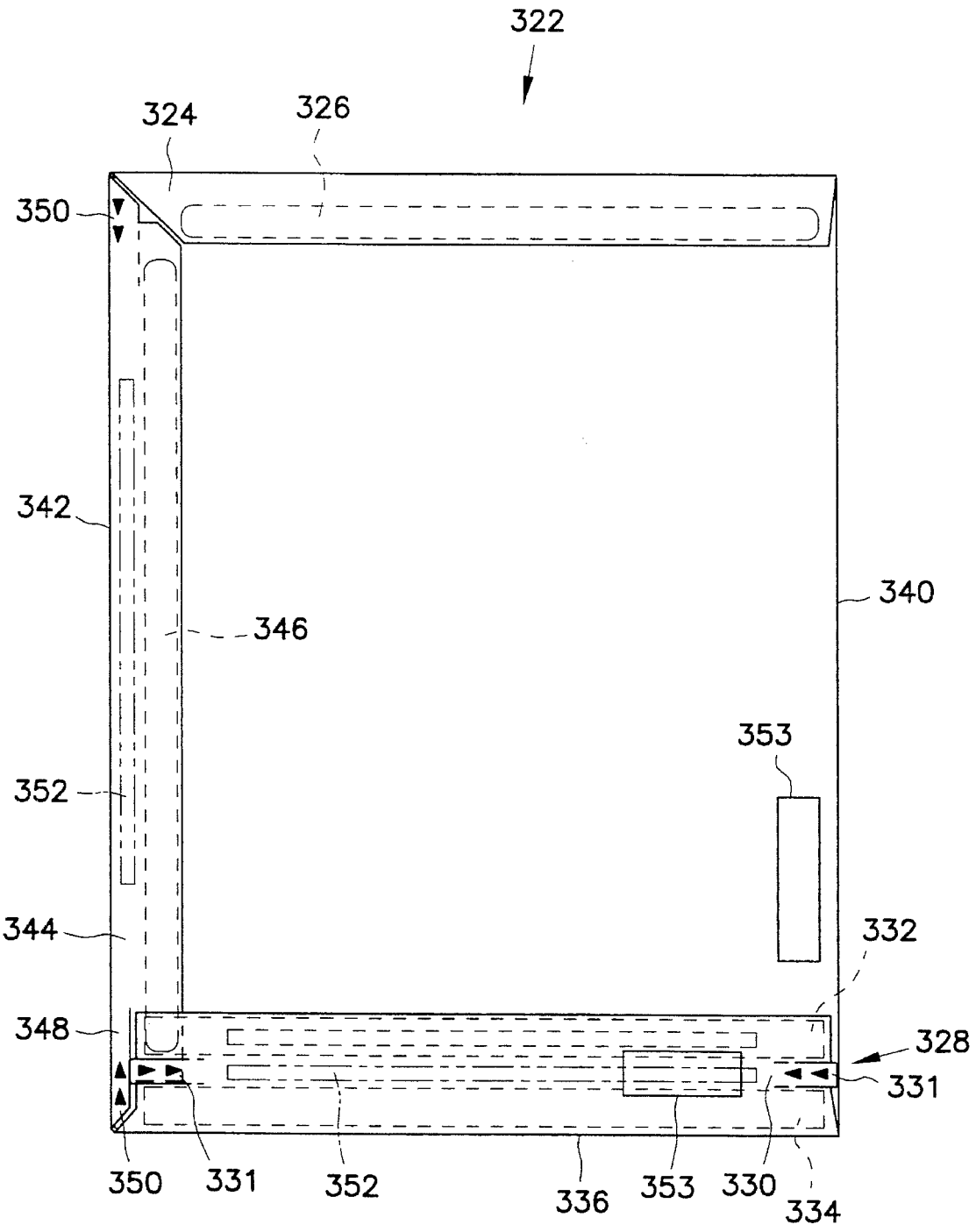
FIG. 8 is a plan view of a second alternative embodiment of the present invention.

Another preferred embodiment of the present invention is depicted in FIG. 8. In this embodiment, again similar to the first embodiment, a multi-use envelope 322 is provided. In this embodiment of the present invention, the envelope 322 includes a permanent closure flap 324 carrying a permanent adhesive region 326. Opposite the first permanent closure flap 324, the envelope includes a first openable short end closure flap 328. The openable flap 328 includes a single opening tear strip 330 generally centrally located in the flap 328 and two adhesive areas, a first adhesive strip 332 and a second adhesive strip 334 closely adjacent to the fold line 336 at which the flap 328 is connected to the envelope 322. One long edge of the envelope 322 is defined by fold line 340 connecting the front and rear side wall panels of the envelope 322. The other long edge of the envelope 322 is defined by a fold line 342 connecting a third closure flap 344 to the envelope 322. The third closure flap 344 carries a permanent adhesive region 346 and is provided with an opening tear strip 348, including starter tabs 350 at each end. The tear strip 348 lies between the fold line 342 and the permanent adhesive area 346.

In use, the envelope 322 has an initial open edge underlying the closure flap 328. The first sender may fill the envelope, remove the release layer covering the adhesive strip 332 and close the flap 328. The first recipient may grasp one of the starter tabs 331 associated with the tear strip 330 to remove it, thereby opening the envelope 322. The envelope may be emptied and refilled, and then resealed by removing the release layer protecting the adhesive strip 334. A second addressee or recipient may gain access to the contents of the envelope 322 by tearing away the tear strip 348. As in all the embodiments described herein, the envelope 322 may carry textual instructional information, as depicted at blocks 352 in FIG. 8. Similarly, security blocks 353, similar to blocks 90, 92 depicted in FIG. 2, may be used with all of the embodiments described herein.

Figure 10:
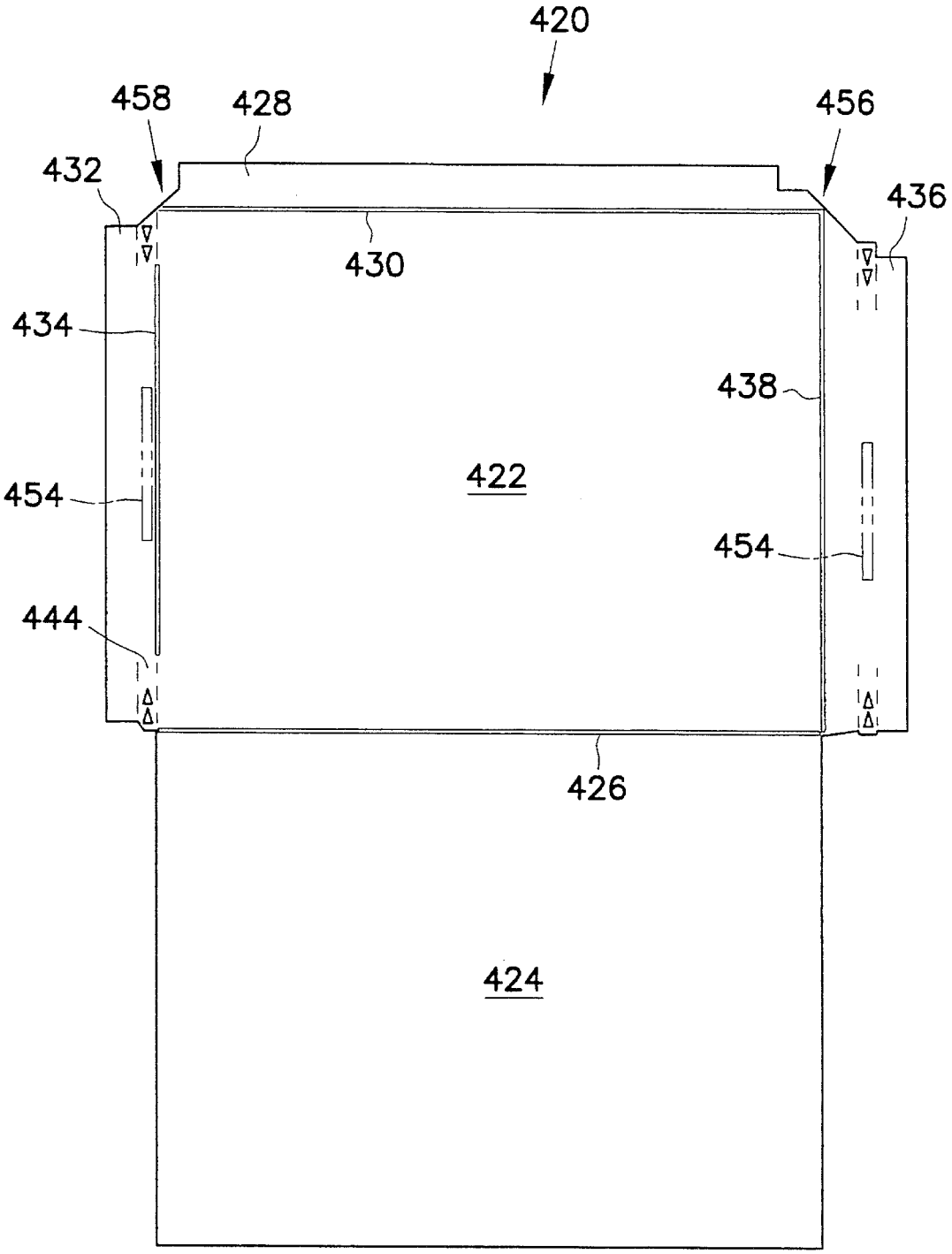
FIG. 10 is a plan view of a die-cut and scored blank for forming a fourth alternative embodiment of the present invention.
Figure 11:
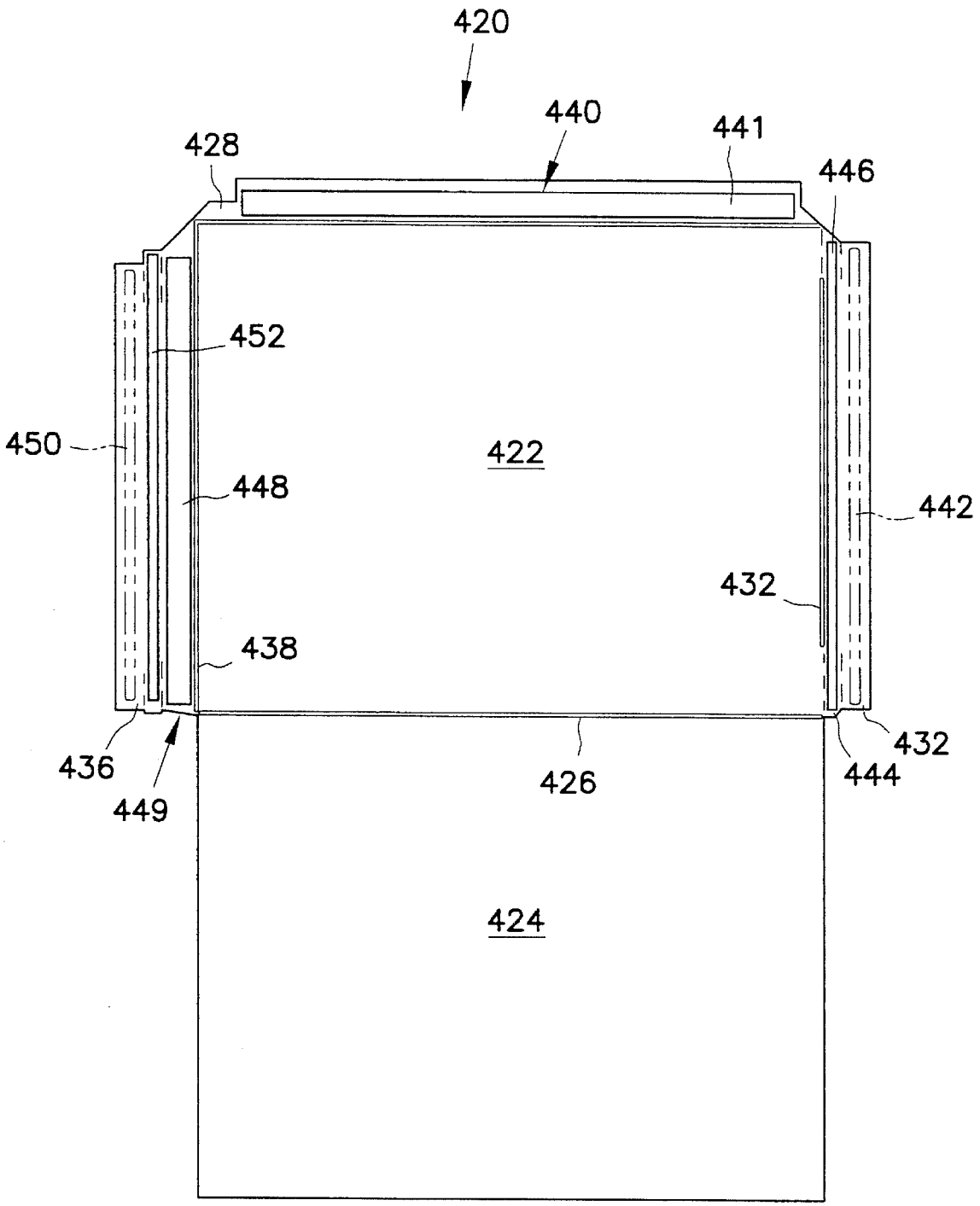
FIG. 11 is a plan view of the other side of the blank depicted in FIG. 10.
Figure 12:
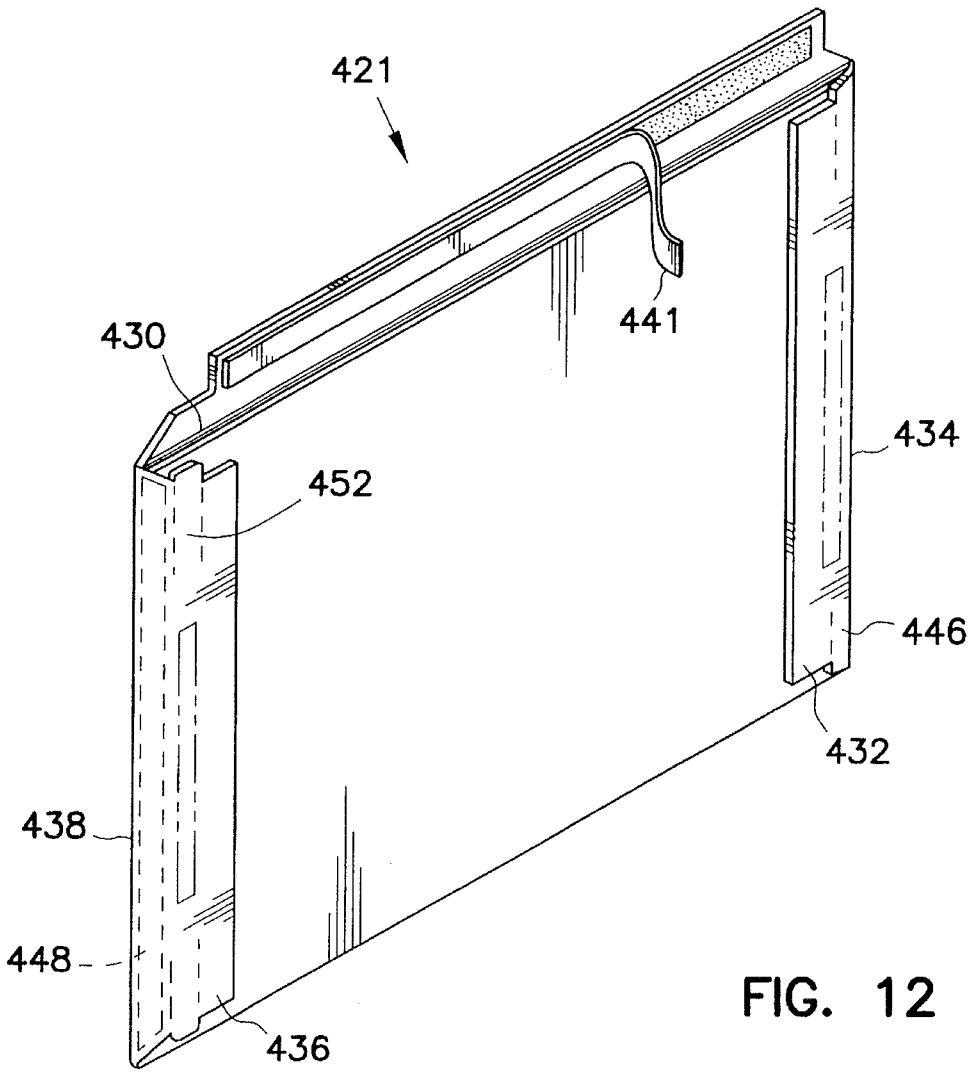
FIG. 12 is a perspective view of the fourth alternative embodiment of the present invention folded up with the peel-off removable adhesive protective seal tape partially removed as it would be removed by the first sender prior to the first sending of the envelope.
Figure 13:
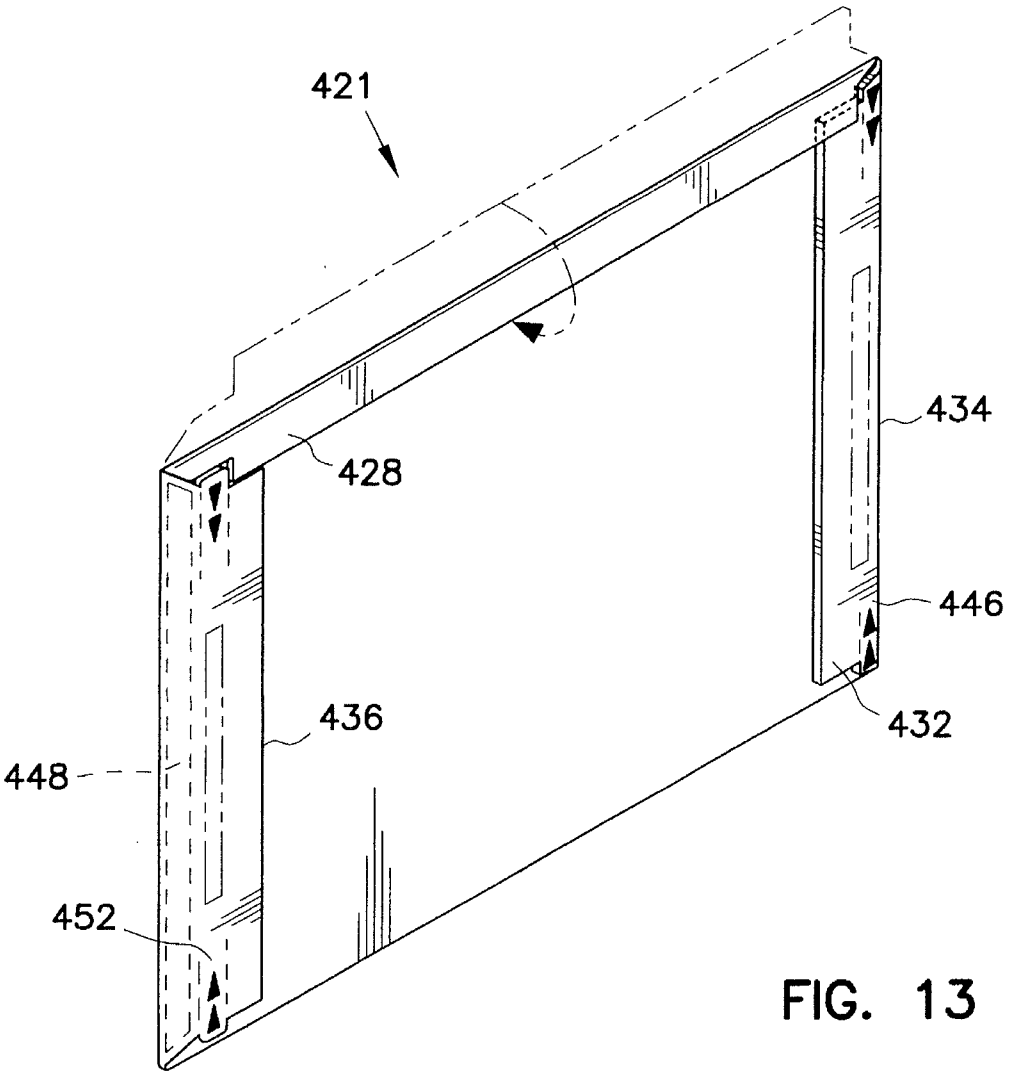
FIG. 13 is a perspective view of the fourth alternative embodiment of the present invention sealed and ready for sending to the first receiver.

A fourth preferred embodiment of the present invention is depicted in FIGS. 10–13. Referring to FIGS. 10 and 11, the blank 420 for this embodiment includes a front panel 422 foldably connected to a rear panel 424 along the fold line 426. A first closure panel 428 is foldably coupled to the front panel 422 along a fold line 430 parallel to the fold line 426. A first openable closure flap 432 is coupled to the front panel 422 along a fold line 434 generally perpendicular to the fold lines 426, 430. A second openable closure flap 436 is foldably coupled to the front panel 422 along a fold line 438 parallel to the fold line 434.

Referring to FIG. 11, the inside surface of the blank 420, specifically the inside of the closure flap 428 carries a permanent adhesive region 440. Similarly, the end flap 432 carries a permanent adhesive strip 442 and an opening tear strip 444, including a tear filament 446. The second openable closure flap 436 includes two adhesive regions 448, 450 and a tear strip 452 therebetween. As in previous embodiments, the envelope 421 may carry indicia or appropriate instructional material as shown at 454 in FIG. 10.

In use, the fourth embodiment envelope 421 is formed by folding the openable closure flaps 432, 436 about fold lines 434, 438, respectively, thereby forming an enclosed envelope with an open edge along fold line 430. The first sender removes the protective peel-off strip 441 from the adhesive strip 440 after filling the envelope. A first recipient grasps the tabs at the end of the tear strip 452 to open the envelope for the first time. After emptying the envelope 421, the first recipient may refill and reseal the envelope by removing the protective layer 448 from the adhesive strip 449 and folding the end flap 436 about the fold line 438 to reseal the envelope. The second recipient may use the tear strip 446 to access the contents.

As shown in FIGS. 10–13, the closure flap 428 includes relieved regions 456 and 458 generally at the ends thereof to accommodate the tear strips, specifically the starter tabs at the ends thereof. This arrangement also permits a generally coplanar envelope to facilitate automatic handling and provide enhanced durability.

Figure 9:
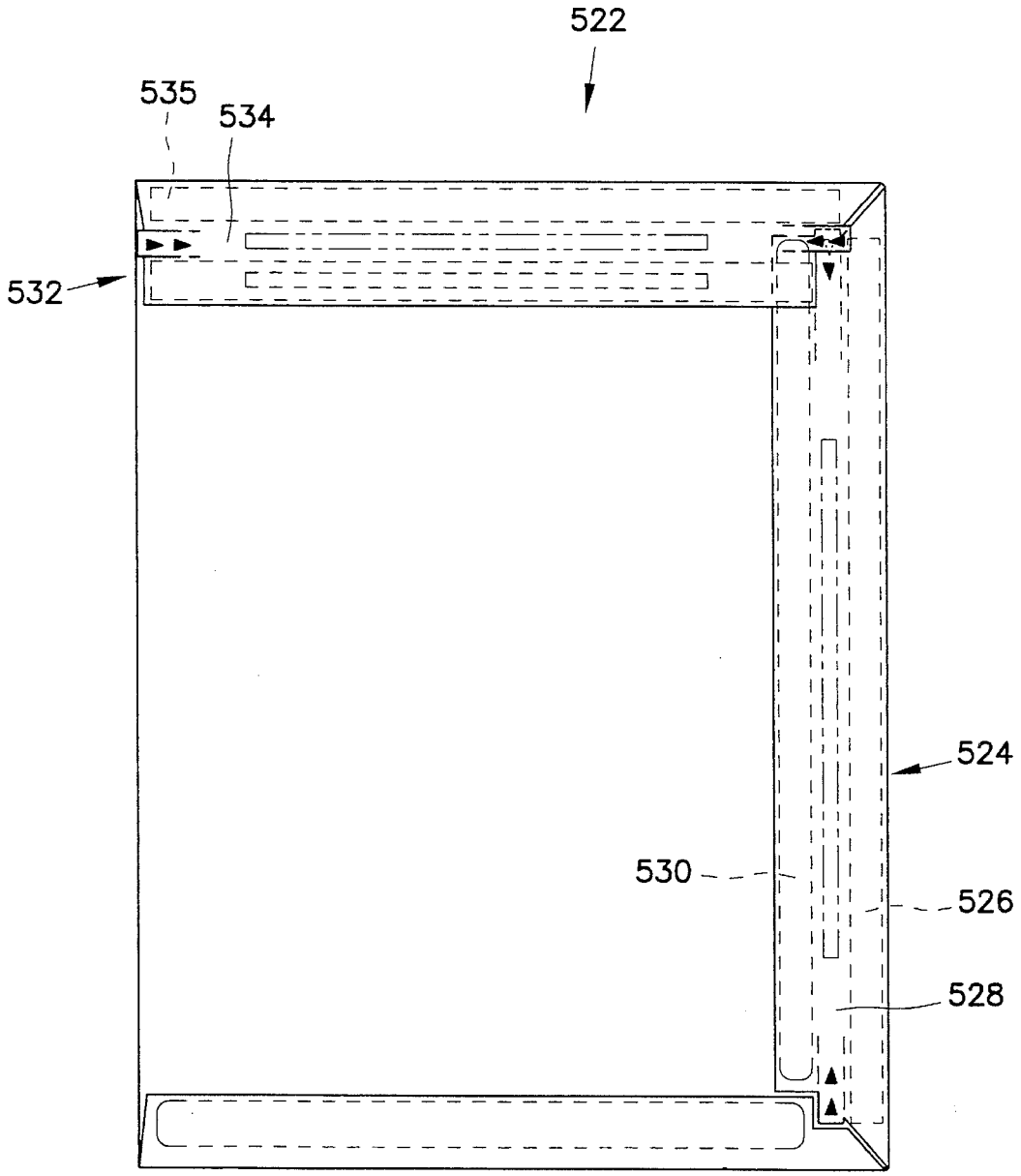
FIG. 9 is a plan view depicting a third alternative embodiment of the present invention.

Yet another embodiment of the present invention is depicted in FIG. 9. The envelope 522 depicted in FIG. 9 is substantially similar to the envelope 322 depicted in FIG. 8. The envelope 522 is adapted to include a "fail-safe" feature by providing the long end closure flap 524 with a second adhesive region 526. The first sender seals the envelope 522 at the openable closure flap 532. Normally, the first recipient would open the envelope 522 by removing tear strip 534, then would refill and reseal the envelope 522 by using adhesive strip 535. Even if the tear strip 528, intended for use by the second recipient, is torn by the first recipient, the envelope 522 can still be used at least twice. The release layer protecting adhesive strip 526 can still be removed by the first recipient and the remaining portion of the flap 524 may be affixed to the body of the envelope 522. The second recipient of the envelope 522 may use the tear strip 534, intended to be used by the first recipient, to open the envelope 522.

In summary, the invention provides a multi-use envelope structure including multiple adhesive strips protected by release layers, and multiple tear strips. The envelope includes a security feature (as depicted in FIGS. 2, 4 and 8) to provide that only the intended recipients open the envelope to access the contents.

The present invention may be changed by modifying the number and shape of the peripheral edges, and by changing the shape of the tear tabs for removing the tear strips. Various appropriate materials may be used to form the envelope, and cushioning material may be incorporated to provide a cushioning envelope for protecting delicate contents, e.g., a layer or layers of material such as "bubble" packaging material may be adhered to the inside of the envelope. For sealing the envelope, double or two-sided adhesive tapes, suitable adhesives or cohesives can be used in the depicted adhesive regions. Various cross-sectional configurations of the envelope can be made. For example, instead of having immediately adjacent main side walls, the side walls might be spaced to provide a box-like mailing container having a width and a contents receiving cavity capable of holding a thick item or a stack of sheets. Of course, the envelope may be provided with indicia, instructional material or graphics as appropriate.

Although descriptions of preferred embodiments have been presented, it will be understood by those skilled in the art that various changes, including those mentioned above, could be made without from the spirit of the present invention. It is desired, therefore, that the preceding descriptions be considered in all respects as illustrative, not restrictive, and that reference be made to the appended claims to indicate the scope of the invention.

What is claimed is:

1. A multi-use envelope comprising:

first and second side walls being permanently sealed so as to form an interior cavity having an opening;

a reusable closure flap foldably connected to the first side wall along a fold line, wherein the closure flap substantially covers the opening and lies on the second side wall when folded along the fold line;

a pair of adhesive regions extending along the closure flap, each of the adhesive regions extending generally parallel to the first fold line and lying proximate the second side wall when the closure flap is folded along the fold line to lie on the second side wall;

a first tear strip in the closure flap, the fast tear strip located substantially between the pair of adhesive regions; and a first security block located on the closure flap, the first security block being intersected by the fast tear strip.

2. An envelope according to claim 1, further comprising:

a second tear strip in the closure flap, the second tear strip located substantially between the fold line and the adhesive region closest to the fold line; and a second security block located on the closure flap, the second security block being intersected by the second tear strip.

3. An envelope according to claim 1, further comprising a first matching security block adapted to receive an indicia matching that placed in the first security block, the first matching security block being located on the envelope distal from the fast security block.

4. An envelope according to claim 2, further comprising a second matching security block adapted to receive an indicia matching that placed in the second security block, the second matching security block being located on the envelope distal from the second security block.

5. An envelope according to claim 1, further comprising a removable portion in the first side wall proximate the opening and further containing substantially all of the first fold line.

6. A multi-use envelope comprising:

first and second side walls being permanently sealed so as to form an interior cavity having an opening;

a reusable closure flap foldably connected to the first side wall along a fold line, wherein the closure flap substantially covers the opening and lies on the second side wall when folded along the fold line;

a pair of adhesive regions extending along the closure flap, each of the adhesive regions extending generally parallel to the first fold line and lying proximate the second side wall when the closure flap is folded along the fold line to lie on the second side wall;

a first tear strip in the closure flap, the first tear strip located substantially between the pair of adhesive regions;

a first security block located on the closure flap, the fast security block being intersected by the tear strip;

a second tear strip in the closure flap, the second tear strip located substantially between the fold line and the adhesive region closest to the fold line; and a second security block located on the closure flap, the second security block being intersected by the second tear strip;

a fast matching security block adapted to receive an indicia matching that placed in the first security block, the first matching security block being located on the envelope distal from the fast security block; and a second matching security block adapted to receive an indicia matching that placed in the second security block the second matching security block being located on the envelope distal from the second security block.

7. An envelope according to claim 6, further comprising a removable portion in the first side wall proximate the opening and further containing substantially all of the first fold line.

* * * * *

UNITED STATES PATENT AND TRADEMARK OFFICE

CERTIFICATE OF CORRECTION

PATENT NO. : 5,503,328

DATED : April 2, 1996

INVENTOR(S) : Roccaforte et al.

It is certified that error appears in the above-indentified patent and that said Letters Patent is hereby corrected as shown below:

Column 9 Line 24 "...the fast tear strip located..." should read --...the first tear strip located...-- therefor.

Column 9 Line 28 "...the fast tear strip..." should read --...the first tear strip...-- therefor.

Column 9 Line 40 "...distal from the fast security..." should read --...distal from the first security...-- therefor.

Column 10 Line 22 ", the fast security block being..." should read --, the first security block being...-- therefor.

Column 10 Line 30 "a fast matching security block..." should read --a first matching security block...-- therefor.

Column 10 Line 33 "...distal from the fast security block; and" should read --distal from the first security block; and-- therefor.

Column 10 Line 36 "placed in the second security block the" should read --placed in the second security block, the-- therefor.

Signed and Sealed this

Sixth Day of August, 1996

Bruce Lehman

*Attest:*

BRUCE LEHMAN

*Attesting Officer*

*Commissioner of Patents and Trademarks*